US010016026B2

(12) United States Patent
Miyazaki et al.

(10) Patent No.: US 10,016,026 B2
(45) Date of Patent: Jul. 10, 2018

(54) SLIDE FASTENER AND METHOD FOR MANUFACTURING SLIDE FASTENER

(75) Inventors: Yuichi Miyazaki, Toyama (JP); Yasuyuki Takabayashi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/346,340

(22) PCT Filed: Sep. 21, 2011

(86) PCT No.: PCT/JP2011/071490

§ 371 (c)(1),
(2), (4) Date: Mar. 21, 2014

(87) PCT Pub. No.: WO2013/042228

PCT Pub. Date: Mar. 28, 2013

(65) Prior Publication Data

US 2014/0230197 A1 Aug. 21, 2014

(51) Int. Cl.
*A44B 19/24* (2006.01)
*A44B 19/40* (2006.01)
(Continued)

(52) U.S. Cl.
CPC ..... *A44B 19/40* (2013.01); *A44B 19/26* (2013.01); *A44B 19/403* (2013.01); *A44B 19/62* (2013.01);
(Continued)

(58) Field of Classification Search
CPC ..... A44B 19/38; A44B 19/00; A44B 19/08; A44B 19/40; A44B 19/62; A44B 19/26
(Continued)

(56) References Cited

U.S. PATENT DOCUMENTS 3,057,031 A * 10/1962 Wahl ..... 24/396
3,162,917 A * 12/1964 Bair ..... A44B 19/32 24/389
(Continued)

FOREIGN PATENT DOCUMENTS

CN 1147356 A 4/1997
GB 2303876 A 3/1997
(Continued)

OTHER PUBLICATIONS

International Search Report, PCT Application No. PCT/JP2011/071490 dated Dec. 13, 2011.
(Continued)

*Primary Examiner* — Jason W San
(74) *Attorney, Agent, or Firm* — Kilpatrick Townsend & Stockton LLP

(57) ABSTRACT

There is provided a slide fastener. A pair of fastener element rows are respectively sewn to opposing tape side edge portions of a pair of fastener tapes with sewing threads. Each of the fastener element rows has a plurality of fastener elements. A slider is configured to engage and disengage the pair of fastener element rows. The pair of fastener tapes and the pair of fastener element rows are colored in different colors. The slide fastener is used such that the fastener element rows are at a back side. A width dimension of a gap between the pair of fastener tapes is set to be 10 to 25% of a width dimension of the pair of fastener element rows that are engaged with each other. The color of the fastener element rows is visible through the gap from a front side of the slide fastener.

13 Claims, 5 Drawing Sheets

(51) Int. Cl.
*A44B 19/26* (2006.01)
*A44B 19/62* (2006.01)
*D05B 35/06* (2006.01)

(52) U.S. Cl.
CPC ..... *D05B 35/064* (2013.01); *Y10T 24/2561* (2015.01)

(58) Field of Classification Search
USPC ..... 24/415, 396, 397, 394
See application file for complete search history.

(56) References Cited

U.S. PATENT DOCUMENTS 3,316,870 A * 5/1967 Burbank ..... 112/475.16
3,490,110 A * 1/1970 Frohlich ..... 24/397
3,668,745 A * 6/1972 Krupp ..... A44B 19/32 24/389
3,750,260 A * 8/1973 Jakob ..... 29/408
3,831,228 A * 8/1974 Jakob ..... 24/394
4,011,895 A * 3/1977 Dal Negro ..... 139/384 B
4,133,084 A * 1/1979 Yoshida ..... 24/393
5,035,029 A * 7/1991 Horita et al. ..... 24/394
5,386,616 A * 2/1995 Norvell ..... 24/389
5,607,621 A * 3/1997 Ishihara ..... C09K 11/02 252/301.36
5,628,094 A 5/1997 Mizuno
6,092,266 A * 7/2000 Lee ..... A44B 19/32 24/384
6,279,209 B1 * 8/2001 Kang ..... B29C 45/14573 24/401
6,383,622 B1 * 5/2002 Ishibashi ..... A44B 19/26 24/381
6,427,294 B1 * 8/2002 Shibaike et al. ..... 24/398
6,591,463 B2 * 7/2003 Wang ..... 24/396
8,966,719 B2 * 3/2015 Kamada ..... A44B 19/12 24/391
9,521,883 B2 * 12/2016 Matsumoto
9,545,134 B1 * 1/2017 Tan ..... A44B 19/32
2001/0004787 A1 * 6/2001 Nagata et al. ..... 24/403
2003/0000051 A1 * 1/2003 Aoshima ..... A44B 17/0029 24/415
2003/0110599 A1 * 6/2003 Wang ..... 24/396
2004/0025307 A1 * 2/2004 Wu ..... 24/396
2006/0008664 A1 * 1/2006 Wakabayashi ..... A44B 18/0069 428/516
2010/0125982 A1 * 5/2010 Chou ..... 24/397
2014/0359978 A1 * 12/2014 Wang ..... A44B 19/42 24/389
2016/0198812 A1 * 7/2016 Tan ..... A44B 19/22 24/389

FOREIGN PATENT DOCUMENTS

HK 1010659 A 3/2000
JP 40-6216 Y1 2/1965
JP 45-4002 Y1 2/1970
JP 64-8905 A 1/1989
JP 9-37817 A 2/1997
JP 2005-171448 A 6/2005
KR 10-0225876 B 10/1999

OTHER PUBLICATIONS

Written Opinion, PCT Application No. PCT/JP2011/071490, dated Dec. 13, 2011.
International Preliminary Report on Patentability, PCT Application No. PCT/JP2011/071490, dated Mar. 25, 2014.

* cited by examiner

SLIDE FASTENER AND METHOD FOR MANUFACTURING SLIDE FASTENER

This application is a national stage application of PCT/JP2011/071490, which is incorporated herein by reference.

TECHNICAL FIELD

The present invention relates to a slide fastener and a method for manufacturing the slide fastener.

BACKGROUND ART

As a conventional slide fastener, there is known a slide fastener in which raw materials of fastener elements rows and sewing threads are colored with a pigment, the colored fastener element rows are attached to uncolored fastener tapes with the colored sewing threads, and then the fastener tapes are colored in a color different from that of the fastener element rows (e.g. Patent Document 1).

PRIOR ART DOCUMENT

Patent Document

Patent Document 1: Japanese Patent Application Publication No. S64-008905A

SUMMARY OF INVENTION

Problems to be Solved by Invention

In the slide fastener described in Patent Document 1, it is possible to improve coloring design properties by differentiating the color of the fastener tapes from the color of the fastener element rows to enhance contrast therebetween. However, to use the slider fastener such that the fastener element rows are at a back side (hereinafter, referred to as "overturned use") and to exhibit the color of the fastener element rows through the gap between the right and left fastener tapes are not considered.

Since the overturned use of the slide fastener is typically a method that is carried out in order to make the fastener element rows less visible, it is preferred that the fastener element rows are not visible through the gap between the right and left faster tapes and thus the gap is minimally provided. Therefore, even though the coloring design properties of the slide fastener are improved as described in Patent Document 1, the color of the fastener element rows is not sufficiently exhibited through the gap between the right and left fastener tapes, and thus the design properties are not exerted adequately.

Accordingly, the present invention has been made in light of the above described problems, and an object of the present invention is to provide a slide fastener and a method for manufacturing the slide fastener, in which the coloring design properties of the slide fastener can be improved by positively exhibiting the color of fastener element rows through the gap between the right and left fastener tapes.

Means for Solving Problems

The object of the present invention is achieved by the following configurations.

(1) A slide fastener that includes: a pair of fastener tapes; a pair of fastener element rows respectively sewn to opposing tape side edge portions of the pair of fastener tapes with sewing threads, each of the fastener element rows having a plurality of fastener elements; and a slider configured to engage and disengage the pair of fastener element rows, wherein the pair of fastener tapes and the pair of fastener element rows are colored in different colors, wherein the slide fastener is used such that the fastener element rows are at a back side, wherein a width dimension A of a gap between the pair of fastener tapes is set to be 10 to 25% of a width dimension B of the pair of fastener element rows that are engaged with each other, and wherein the color of the fastener element rows is visible through the gap from a front side of the slide fastener.

(2) The slide fastener according to (1), wherein a width dimension C between a tape end of each of the tape side edge portions and an end of a corresponding one of the sewing threads at a side of the tape end is set to be 0.1 to 0.8 mm.

(3) The slide fastener according to (1) or (2), wherein the pair of fastener element rows are colored in a fluorescent color.

(4) A method for manufacturing a slide fastener which includes: a pair of fastener tapes; a pair of fastener element rows respectively sewn to opposing tape side edge portions of the pair of fastener tapes with sewing threads, each of the fastener element rows having a plurality of fastener elements; and a slider configured to engage and disengage the pair of fastener element rows, the method including: supplying the pair of fastener tapes to a sewing machine; supplying the pair of fastener element rows that are engaged with each other to the sewing machine; setting, at the sewing machine, a gap between the pair of fastener tapes to a predetermined width dimension A; and sewing, at the sewing machine, the pair of fastener element rows to the tape side edge portions of the pair of fastener tapes, respectively.

(5) The method for manufacturing a slider fastener, according to (4), wherein a guide section configured to set the width dimension A is disposed between the tape side edge portions of the pair of fastener tapes, and wherein the pair of fastener tapes are transported along the guide section.

Advantageous Effects of Invention

According to the slide fastener of the present invention, the pair of fastener tapes and the pair of fastener element rows are colored in different colors, the slide fastener is used such that the fastener element rows are at the back side, the width dimension A of the gap between the pair of fastener tapes is set to be 10 to 25% of the width dimension B of the pair of fastener element rows in the engaged state, and the color of the fastener element rows is visible through the gap from the front side of the slide fastener. Accordingly, it is possible to positively exhibit the color of the fastener element rows through the gap between the right and left fastener tapes, thereby improving the coloring design property of the slider fastener.

EMBODIMENTS OF INVENTION

Hereinafter, an embodiment of a slide fastener according to the present invention will be described in detail with reference to the accompanying drawings. In the following description, as for fastener tapes, a front side refers to a near side with respect to the paper surface of FIG. 1, a back side refers to a far side with respect to the paper surface of FIG. 1, an upper side refers to an upper side with respect to the paper surface of FIG. 1, a lower side refers to a lower side with respect to the paper surface of FIG. 1, a left side refers to a left side with respect to the paper surface of FIG. 1, and a right side refers to a right side with respect to the paper surface of FIG. 1. As for a slider and fastener elements, an upper side refers to a near side with respect to the paper surface of FIG. 1, a lower side refers to a far side with respect to the paper surface of FIG. 1, a front side refers to an upper side with respect to the paper surface of FIG. 1, a rear side refers to a lower side with respect to the paper surface of FIG. 1, a left side refers to a left side with respect to the paper surface of FIG. 1, and a right side refers to a right side with respect to the paper surface of FIG. 1. In addition, the right and left direction of the fastener tapes and the slider is also referred to as a width direction. The upward and downward direction of the fastener tapes is also referred to as a longitudinal direction.

Figure 1:
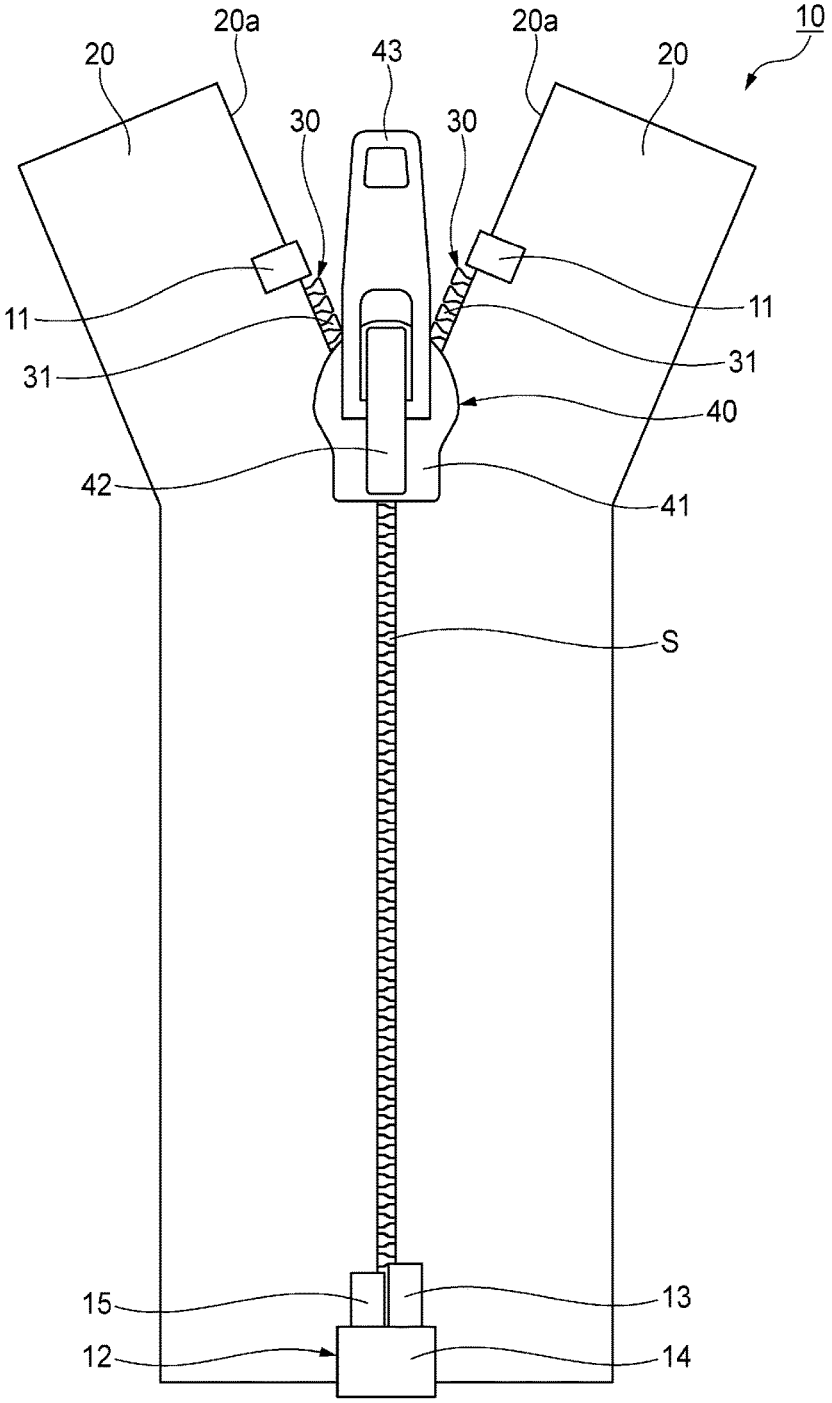
FIG. 1 is a front view illustrating an embodiment of a slide fastener according to the present invention.

As shown in FIG. 1, the slide fastener 10 according to this embodiment includes a pair of right and left fastener tapes 20 which are woven or knitted, a pair of right and left fastener element rows 30 which are respectively provided on opposing tape side edge portions 20*a* of the pair of right and left fastener tapes 20, each of the pair of right and left fastener element rows 30 having a plurality of fastener elements 31, a slider 40 which is configured to engage and disengage the pair of right and left fastener element rows 30, top end stops 11 which are respectively provided on upper end portions of the pair of right and left fastener element rows 30, and an separable end stop 12 which is provided on lower end portions of the pair of right and left fastener element rows 30. In addition, the slide fastener 10 is structured to be attached to an article, such as clothes or a bag, such that the fastener element rows 30 are at a back side.

The separable end stop 12 includes a box pin 13 and a box body 14 which are formed on a lower end portion of the tape side edge portion 20*a* of the right fastener tape 20 and an insert pin 15 which is formed on a lower end portion of the tape side edge portion 20*a* of the left fastener tape 20 and configured to be insertable into the box body 14. The separable end stop 12 may be a bottom end stop.

Figure 2:
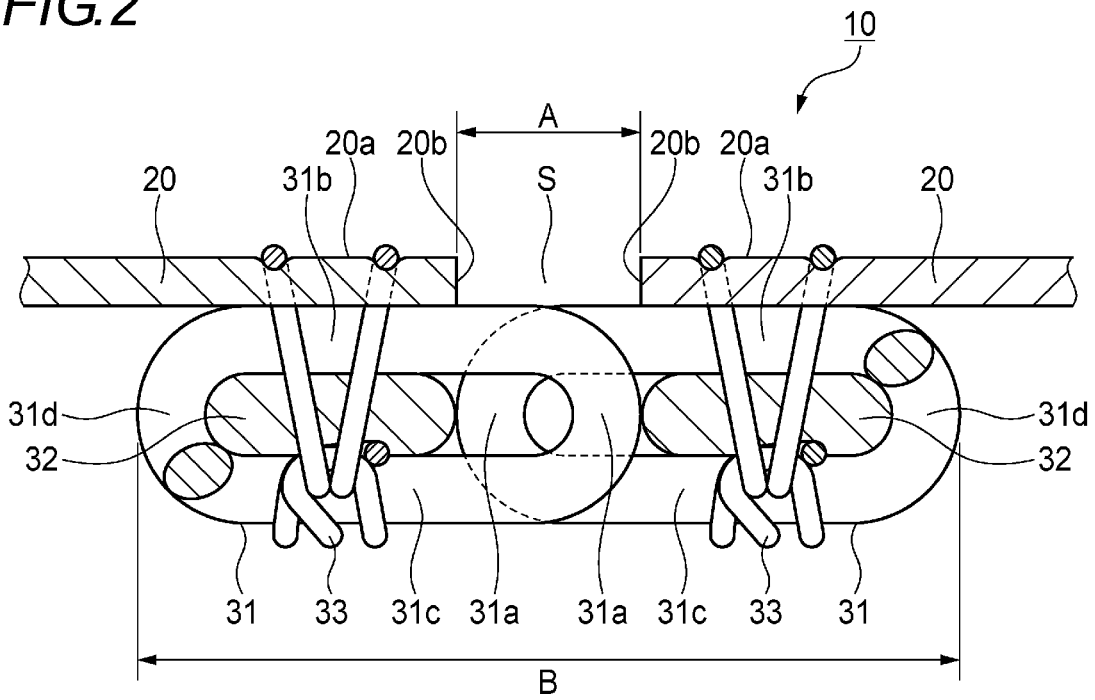
FIG. 2 is a cross-sectional view of the slide fastener shown in FIG. 1.

As shown in FIG. 2, each of the fastener element rows 30 is a coil-shaped fastener element row that is formed by winding a monofilament made of synthetic resin in a preset direction, and includes a plurality of fastener elements 31. A core string 32 is inserted into each of the fastener element rows 30, and then the fastener element row 30 is sewn to a back surface (lower surface) of the tape side edge portion 20*a* of the fastener tape 20 with the sewing threads 33 by double chain stitch. The synthetic resin material for the monofilament may be polyester, nylon, or the like.

Each of the fastener elements 31 comprises an engaging head section 31*a* which engages with and disengages from a counterpart fastener element 31, an upper leg section 31*b* which extends outward in the width direction from an upper end portion of the engaging head section 31*a*, a lower leg section 31*c* which extends outward in the width direction from a lower end portion of the engaging head section 31*a*, and a connecting section 31*d* which connects an outer end portion of the upper leg section 31*b* in the width direction to an outer end portion of the lower leg section 31*c* of the adjacent fastener element 31 in the width direction. In addition, the engaging head section 31*a* and portions of the upper leg section 31*b* and the lower leg section 31*c* extend beyond the tape end 20*b* of the fastener tape 20 and are disposed at an inner side in the width direction. That is, the engaging head section 31*a* and the portions of the upper leg section 31*b* and the lower leg section 31*c* are disposed at positions that are not covered by the fastener tape 20 in the front-back direction of the fastener tape 20.

As shown in FIG. 1, the slider 40 comprises a body 41, a pull tab attachment section 42 which is provided on an upper surface of the body 41, and a pull tab 43 which is attached to the pull tab attachment section 42. Moving the slider 40 toward the top end stops 11 causes the pair of right and left fastener element rows 30 to engage with each other. Moving the slider 40 toward the separable end stop 12 causes the pair of right and left fastener element rows 30 to disengage from each other.

According to this embodiment, the pair of right and left fastener tapes 20 and the pair of right and left fastener element rows 30 are colored in different colors. Specifically, when the fastener tapes 20 (the fastener element rows 30) are colored in a deep color (e.g. red, blue, green, gold, silver, or the like), the fastener element rows 30 (the fastener tapes 20) are colored in a light color (e.g. white, yellow, light blue, or the like) to enhance contrast therebetween.

The fastener tapes 20 and the fastener element rows 30 are colored in separate processes. At one process, the fastener tapes 20 are dyed. At another process, the fastener element rows 30 are colored by kneading a pigment into the fastener element rows 30 or plating the circumferential surfaces of the fastener element rows 30.

In addition, the pair of right and left fastener element rows 30 may be colored in a fluorescent color. The fluorescent color is given by a luminescent paint such as a fluorescent paint, a phosphorescent paint, a self-luminous paint, and the like. For example, the luminescent paint may be one that generates bright light when irradiated with a short wavelength light ray close to purple (e.g. ultraviolet (UV) light). As fluorescent materials used for the fluorescent paint, anthracene derivatives may be mainly used as organic materials, and zinc sulfide and cadmium sulfide may be used as inorganic materials. As phosphorescent materials used for the phosphorescent paint, zinc sulfide-based material, copper sulfide-based material, calcium sulfide-based material, bismuth sulfide-based material, and the like may be used. As self-luminous paint, tritium luminous paint may be used. The luminescent paint is composed by dispersing the luminescent material in a vehicle such as acrylic resin monomer, according to the usual manner. A fluorescent pigment may be kneaded into the fastener element rows 30. In this case, the fluorescent pigment may be a sulfide of zinc, cadmium, barium, strontium, yttrium, or the like.

Figure 3:
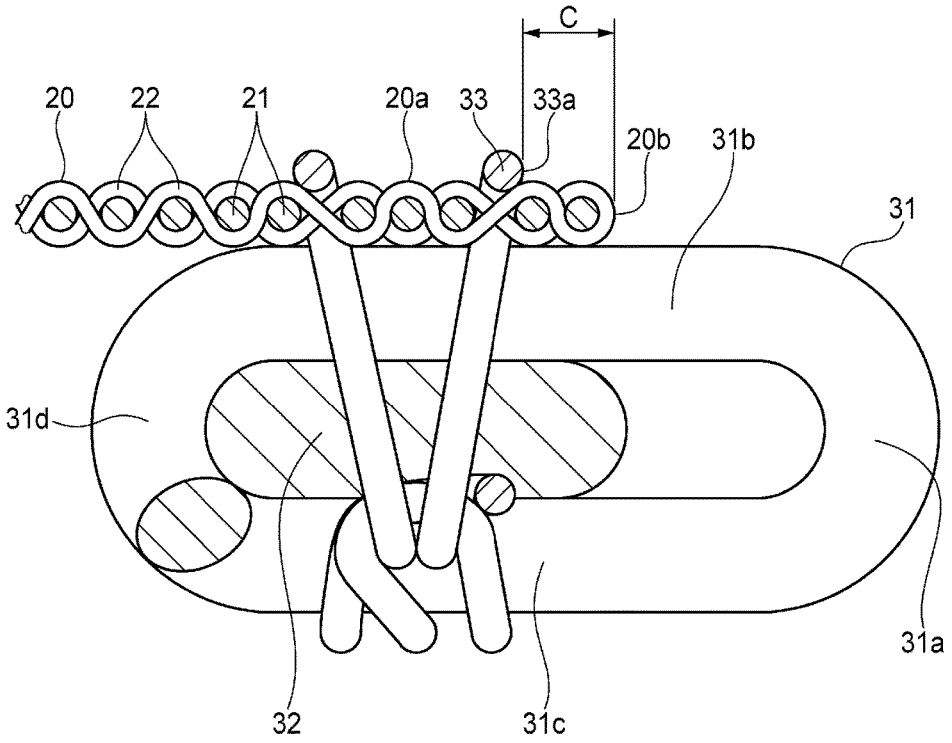
FIG. 3 is an enlarged cross-sectional view of surroundings of the left fastener element shown in FIG. 2.

According to this embodiment, as shown in FIG. 2, a gap S is formed between the pair of right and left fastener tapes 20. Specifically, the tape side edge portions 20*a* of the right and left fastener tapes 20 have tape ends 20*b* which oppose each other in the width direction (the right and left direction) of the fastener tapes 20. The gap S is formed between the tape ends 20*b*. The width dimension A of the gap S is set to be 10 to 25% of the width dimension B of the pair of right and left fastener element rows 30 that are engaged with each other. In addition, as shown in FIG. 3, the width dimension C between the tape end 20*b* of the tape side edge portion 20*a* and the end 33*a* of the sewing thread 33 at a side of the tape end 20*b* is set to be 0.1 to 0.8 mm. Therefore, the wide gap S can be obtained while the sewing strength of the fastener element row 30 is realized, so that the color of the fastener element row 30 is visible through the gap S from the front side of the slide fastener 10.

In addition, two warp threads 21 are disposed in the range of the width dimension C. The number of the warp threads 21 is not limited to two but may be three or less. Reference numeral 22 in FIG. 3 indicates wefts.

A description will be made below to specific embodiments of the width dimension A of the gap S between the pair of right and left fastener tapes 20 and the width dimension B of the pair of right and left fastener element rows 30 that are engaged with each other.

In a first embodiment, the width dimension A ranges from 0.7 to 1.1 mm and the width dimension B ranges from 6.4 to 6.7 mm. In this case, the width dimension A is a dimension that ranges from 10 to 18% of the width dimension B. Preferably, the width dimension A ranges from 0.95 to 1.05 mm and the width dimension B ranges from 6.45 to 6.65 mm. In this case, the width dimension A is a dimension that ranges from 14 to 17% of the width dimension B.

In a second embodiment, the width dimension ranges from 0.45 to 0.55 mm and the width dimension B ranges from 4.15 to 4.35 mm. In this case, the width dimension A is a dimension that ranges from 10 to 13% of the width dimension B.

In a third embodiment, the width dimension ranges from 2.35 to 2.55 mm and the width dimension B ranges from 10.5 to 11.0 mm. In this case, the width dimension A is a dimension that ranges from 21 to 25% of the width dimension B.

A description will be made below to a method for manufacturing the slide fastener.

The method for manufacturing the slide fastener 10 according to this embodiment includes a process of supplying a pair of right and left fastener tapes 20 to a sewing machine 50, a process of supplying a pair of right and left fastener element rows 30 that are engaged with each other to the sewing machine 50, a process of setting, at the sewing machine 50, the gap S between the pair of right and left fastener tapes 20 to a preset width dimension A, and a process of sewing, at the sewing machine 50, the pair of right and left fastener element rows 30 to tape side edge portions 20*a* of the pair of right and left fastener tapes 20, respectively.

Figure 4:
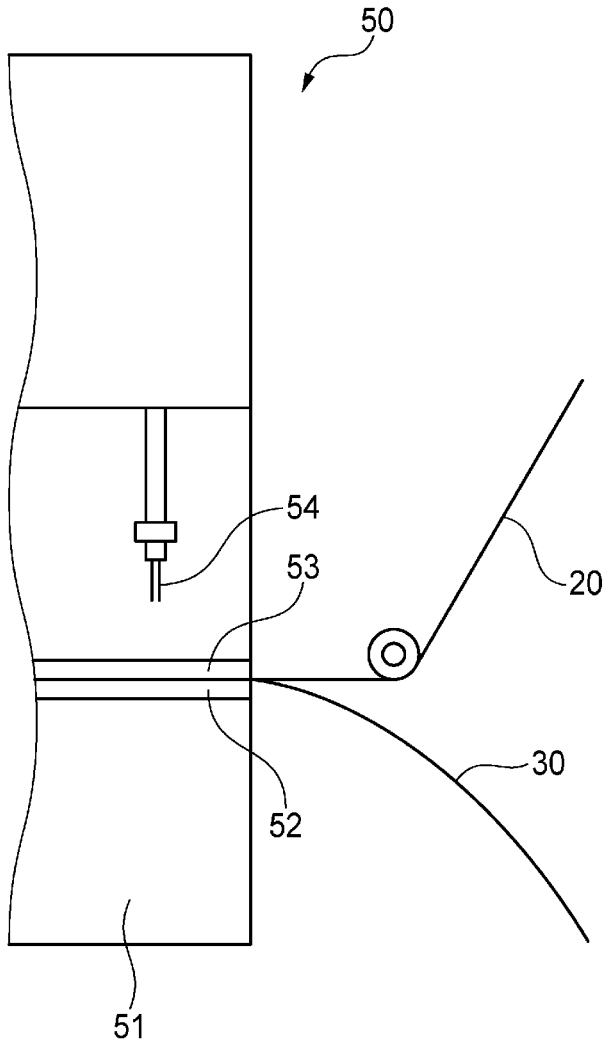
FIG. 4 is a schematic side view of a sewing machine for sewing a fastener element row to a fastener tape.
Figure 5:
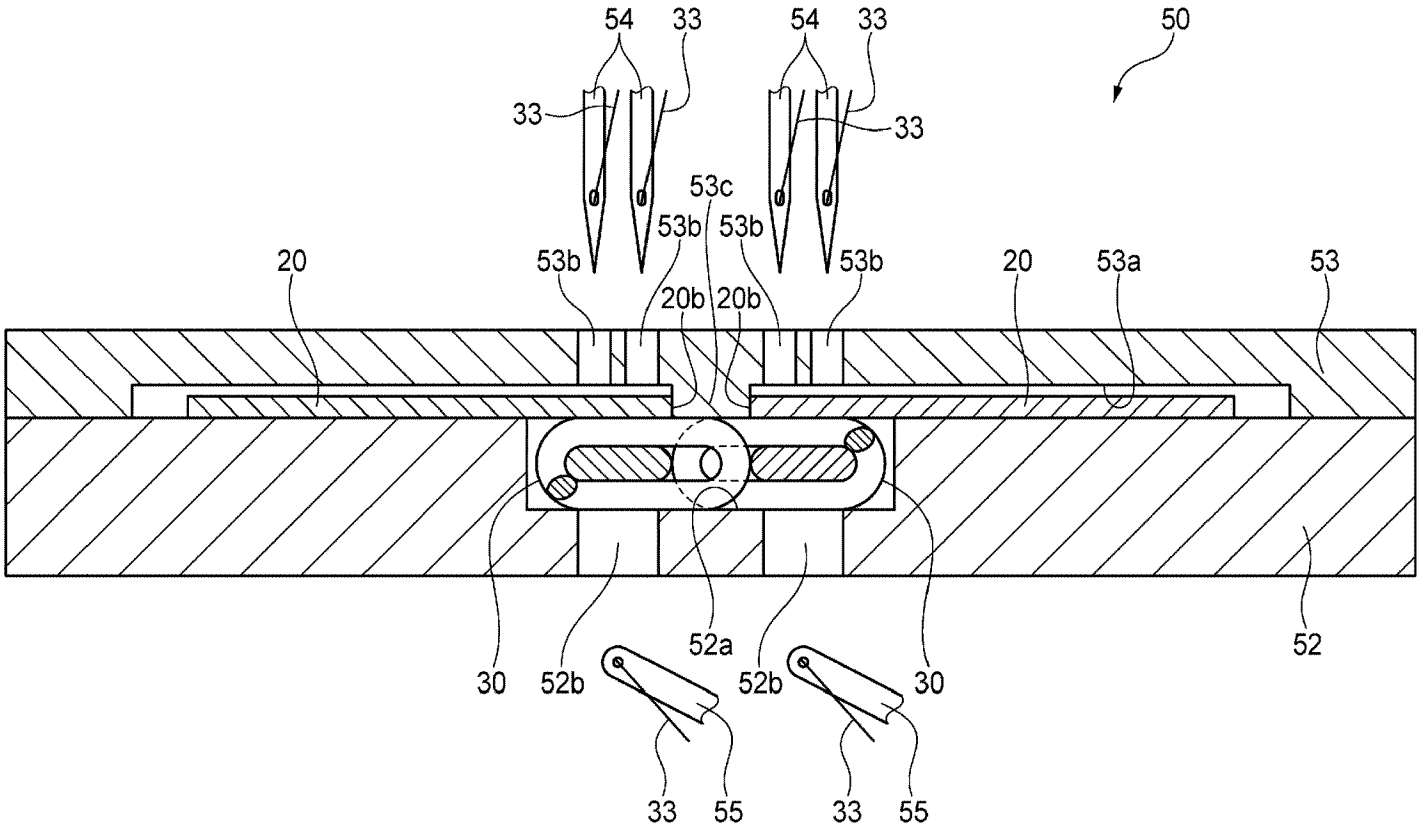
FIG. 5 is an enlarged cross-sectional view of main parts of the sewing machine shown in FIG. 4.

As shown in FIG. 4 and FIG. 5, the sewing machine 50 includes a base 51, an element guide plate 52 which is attached to an upper surface of the base 51 and is configured to guide the pair of right and left fastener element rows 30 that are supplied, a tape guide plate 53 which is attached to an upper surface of the element guide plate 52 and is configured to guide the pair of right and left fastener tapes 20 that are supplied, two pair of right and left sewing needles 54, i.e. a total of four sewing needles 54 which are disposed above the tape guide plate 53, and a pair of right and left loopers 55 which are disposed below the element guide plate 52.

The upper surface of the element guide plate 52 is formed with an element guide groove 52*a* configured to guide the pair of right and left fastener element rows 30 that are engaged with each other in the longitudinal direction. The element guide groove 52*a* is formed with a pair of right and left needle through-holes 52*b* penetrating through the element guide plate 52 in the upward-downward direction, and allowing the sewing needles 54 to pass through toward the element guide recess 52*a*.

The lower surface of the tape guide plate 53 is formed with a tape guide groove 53*a* configured to guide the pair of right and left fastener tapes 20 in the longitudinal direction. The tape guide groove 53*a* is formed with two pairs of right and left needle through-holes 53*b*, i.e. a total of four needle through-holes 53*b* penetrating through the tape guide plate 53 in the upward-downward direction, and allowing the sewing needles 54 to pass through toward the tape guide groove 53*a*. A guide section 53*c* is formed at the center of the tape guide groove 53*a* in the width direction (the right and left direction). The guide section 53*c* protrudes from the lower surface of the tape guide plate 53, and extends parallel to the tape guide groove 53*a*. The guide section 53*c* has right and left surfaces which intersect perpendicularly with the lower surface of the tape guide plate 53. The width dimension A of the gap S between the pair of right and left fastener tapes 20 is set between the right and left surfaces of the guide section 53*c*. Therefore, the width dimension of the guide section 53*c* is the same as the width dimension A of the gap S.

In the sewing machine 50 configured as above, first, the pair of right and left fastener tapes 20 are supplied to the tape guide groove 53*a* of the tape guide plate 53 and the pair of right and left fastener element rows 30 that are engaged with each other are supplied to the element guide groove 52*a* of the element guide plate 52. In subsequence, in the pair of right and left fastener tapes 20, the tape end 20*b* of the right fastener tape 20 comes in contact with the right surface of the guide section 53*c*, and the tape end 20*b* of the left fastener tape 20 comes in contact with the left surface of the guide section 53*c*. That is, the guide section 53*c* is disposed between the tape ends 20*b* of the tape side edge portions 20*a* of the pair of right and left fastener tapes 20. As the tape end 20*b* of each of the fastener tapes 20 is transported along the guide section 53*c*, the gap S between the pair of right and left fastener tapes 20 is set to the preset width dimension A. Afterwards, the pair of right and left fastener element rows 30 are sewn to the tape side edge portions 20*a* of the pair of right and left fastener tapes 20, respectively, with using the two pairs of right and left sewing needles 54 and the pair of right and left loopers 55.

As described above, according to the slide fastener 10 according to this embodiment, the pair of right and left fastener tapes 20 and the pair of right and left fastener element rows 30 are colored in different colors, the slide fastener 10 is used such that the fastener element rows 30 are at a back side, the width dimension A of the gap S between the pair of right and left fastener tapes 20 is set to be 10 to 25% of the width dimension B of the pair of right and left fastener element rows 30 in the engaged state, and the color of the fastener element rows 30 is visible through the gap S from the front side of the slide fastener 10. Accordingly, the color of the fastener element rows 30 can be positively exhibited through the gap S between the right and left fastener tapes 20, thereby improving the coloring design property of the slider fastener 10.

The present invention is not limited to those that were illustrated in the foregoing embodiments but can be suitably changed without departing from the concept of the present invention.

DESCRIPTION OF REFERENCE NUMERALS

10 Slide Fastener
20 Fastener Tape

20*a* Tape Side Edge Portion
20*b* Tape End
30 Fastener Element Row
31 Fastener Element
33 Sewing Thread
33*a* End of Sewing Thread
40 Slider
50 Sewing Machine
53*c* Guide Section
A Width Dimension of Gap
B Width Dimension of Pair of Right and Left Fastener Element Rows
C Width Dimension between One End of Tape and One End of Sewing Thread
S Gap

The invention claimed is:

1. A slide fastener comprising:
a pair of fastener tapes;
a pair of fastener element rows respectively sewn to opposing tape side edge portions of the pair of fastener tapes with sewing threads, each of the fastener element rows having a plurality of fastener elements;
a pair of core strings which are inserted into the pair of fastener element rows, respectively;
the sewing threads, wherein a first sewing thread of the sewing threads contacts a first one of the pair of fastener element rows and a second sewing thread of the sewing threads contacts a second one of the pair of fastener element rows; and
a slider configured to engage and disengage the pair of fastener element rows,
wherein the slider includes a pull tab which is arranged at a side of the pair of fastener tapes opposite a side of the pair of fastener tapes with the fastener element rows,
wherein the pair of fastener tapes and the pair of fastener element rows are colored in different colors,
wherein a width dimension of a gap between the pair of fastener tapes when the pair of fastener element rows are engaged with each other is set to be 10 to 25% of a width dimension of the pair of fastener element rows that are engaged with each other,
wherein the color of the fastener element rows is visible through the gap from the side of the pair of fastener tapes with the pull tab, and
wherein the sewing threads for respectively sewing the pair of fastener element rows to the opposing tape side edge portions of the pair of fastener tapes penetrate through the core strings inserted into the pair of fastener element rows, respectively.

2. The slide fastener according to claim 1, wherein a width dimension between a tape end of each of the tape side edge portions and an end of a corresponding one of the sewing threads at a side of the tape end is set to be 0.1 to 0.8 mm.

3. The slide fastener according to claim 1, wherein the pair of fastener element rows are colored in a fluorescent color.

4. A method for manufacturing a slide fastener which comprises:
a pair of fastener tapes;
a pair of fastener element rows respectively sewn to opposing tape side edge portions of the pair of fastener tapes with sewing threads, each of the fastener element rows having a plurality of fastener elements;
a pair of core strings which are inserted into the pair of fastener element rows, respectively; and
a slider configured to engage and disengage the pair of fastener element rows,
wherein the slider includes a pull tab which is arranged at a side of the pair of fastener tapes opposite a side of the pair of fastener tapes with the fastener element rows,
the method comprising:
supplying the pair of fastener tapes to a sewing machine;
supplying the pair of fastener element rows that are engaged with each other to the sewing machine;
setting, at the sewing machine, a gap between the pair of fastener tapes to a predetermined width dimension; and
sewing, at the sewing machine, the pair of fastener element rows to the tape side edge portions of the pair of fastener tapes, respectively, with the sewing threads, wherein a first sewing thread of the sewing threads contacts a first one of the pair of fastener element rows and a second sewing thread of the sewing threads contacts a second one of the pair of fastener element rows;
wherein the predetermined width dimension of the gap between the pair of fastener tapes when the pair of fastener element rows are engaged with each other is set to be 10 to 25% of a width dimension of the pair of fastener element rows that are engaged with each other,
wherein the pair of fastener tapes and the pair of fastener element rows are colored in different colors, and
wherein the sewing threads for respectively sewing the pair of fastener element rows to the opposing tape side edge portions of the pair of fastener tapes penetrate through the core strings inserted into the pair of fastener element rows, respectively.

5. The method for manufacturing the slide fastener, according to claim 4,
wherein a guide section configured to set the width dimension is disposed between the tape side edge portions of the pair of fastener tapes, and
wherein the pair of fastener tapes are transported along the guide section.

6. The slide fastener according to claim 1, wherein the pair of fastener tapes are dyed.

7. The slide fastener according to claim 1, wherein the pair of fastener element rows are colored by kneading a pigment into the fastener element rows.

8. The slide fastener according to claim 1, wherein the pair of fastener element rows are colored by plating.

9. The method for manufacturing the slide fastener, according to claim 4, wherein the pair of fastener tapes are dyed.

10. The method for manufacturing the slide fastener, according to claim 4, wherein the pair of fastener element rows are colored by kneading a pigment into the fastener element rows.

11. The method for manufacturing the slide fastener, according to claim 4, wherein the pair of fastener element rows are colored by plating.

12. A slide fastener comprising:
a pair of fastener tapes;
a pair of fastener element rows respectively sewn to opposing tape side edge portions of the pair of fastener tapes with sewing threads, each of the fastener element rows having a plurality of fastener elements;
a pair of core strings which are inserted into the pair of fastener element rows, respectively;
the sewing threads, wherein a first sewing thread of the sewing threads contacts a first one of the pair of fastener element rows and a second sewing thread of the sewing threads contacts a second one of the pair of fastener element rows; and a slider configured to engage and disengage the pair of fastener element rows, wherein the slider includes a pull tab which is arranged at a side of the pair of fastener tapes opposite a side of the pair of fastener tapes with the fastener element rows, wherein the pair of fastener tapes and the pair of fastener element rows are colored in different colors, wherein when the pair of fastener element rows are engaged with each other, a gap is formed between the pair of fastener tapes, and wherein the color of the fastener element rows is visible through the gap from the side of the pair of fastener tapes with the pull tab, and wherein the sewing threads for respectively sewing the pair of fastener element rows to the opposing tape side edge portions of the pair of fastener tapes penetrate through the core strings inserted into the pair of fastener element rows, respectively.

13. The method for manufacturing the slide fastener, according to claim 4, further comprising:

coloring the pair of fastener tapes and the pair of fastener element rows in separate processes.

* * * * *